US007721794B2

(12) United States Patent
Heidenreich et al.

(10) Patent No.: US 7,721,794 B2
(45) Date of Patent: May 25, 2010

(54) FIN STRUCTURE FOR HEAT EXCHANGER

(75) Inventors: Michael E. Heidenreich, Olive Branch, MS (US); Hailing Wu, Germantown, TN (US)

(73) Assignee: Lennox Industries Inc., Richardson, TX (US)

( * ) Notice: Subject to any disclaimer, the term of this patent is extended or adjusted under 35 U.S.C. 154(b) by 179 days.

(21) Appl. No.: 11/673,127

(22) Filed: Feb. 9, 2007

(65) Prior Publication Data

US 2008/0190588 A1 Aug. 14, 2008

(51) Int. Cl.
*F28D 1/04* (2006.01)

(52) U.S. Cl. ..... 165/153; 165/181

(58) Field of Classification Search ..... 165/151, 165/153, 181

See application file for complete search history.

(56) References Cited

U.S. PATENT DOCUMENTS 3,003,749 A * 10/1961 Morse ..... 165/152
4,434,844 A 3/1984 Sakitani et al.
4,705,105 A * 11/1987 Cur ..... 165/151
4,723,599 A 2/1988 Hanson
4,998,580 A 3/1991 Guntly et al.
5,035,052 A * 7/1991 Suzuki et al. ..... 165/151
5,042,576 A 8/1991 Broadbent
5,341,870 A * 8/1994 Hughes et al. ..... 165/110
5,372,188 A 12/1994 Dudley et al.
5,509,469 A 4/1996 Obosu
5,722,485 A 3/1998 Love et al.
5,730,214 A 3/1998 Beamer et al.
5,752,567 A 5/1998 Obosu
6,805,193 B2 10/2004 Hu et al.

OTHER PUBLICATIONS

Wu, H.L. et al., "Air Flow and Heat Transfer in Louver-Fin Round-Tube Heat Exchangers", article, ASME Journal of Heat Transfer, Feb. 2007, pp. 1-11, vol. 129.

* cited by examiner

*Primary Examiner*—Teresa J Walberg

(57) ABSTRACT

The invention involves a flat fin heat exchanger configuration 10 with a plurality of louvers 26 that are raised above the plane of the fin 16 between adjacent tube holes 19, 20 that receive tubes 14. Various alternative patterns of louvers enhance the heat transfer characteristics of the fin, and allow for the use of thinner materials to lower cost without diminishing performance. The exterior fin surface redirects air flow from the leading edge to the trailing edge of the fin. This effect directs the air flow over and in between the interrupted surfaces, thus breaking up air boundary layer around the fin. The louvers of the fin are oriented relative to the air flow in such a manner that each louver in effect creates another leading edge, thus contributing to a higher heat transfer coefficient.

20 Claims, 6 Drawing Sheets

(STRAIGHT)

(CURVILINEAR)

LOUVER PITCH MAY VARY (TOP VIEW)

(VIEW - A)

(SECTION B-B)

FIN STRUCTURE FOR HEAT EXCHANGER

BACKGROUND OF THE INVENTION

1. Field of the Invention

This invention relates to heat exchangers that have fins which are provided with louvers.

2. Background Art

Heat exchangers are used in air conditioners and heat pumps to transfer energy between two fluid media, e.g., a refrigerant fluid and air. The refrigerant fluid is circulated through relatively small diameter tubes and air is passed over the surface of the tubes so that heat may be transferred to the refrigerant fluid through the material of the heat exchanger tube from the ambient air. Thin metal sheets, or fins, can be attached to the heat exchanger tubes, thus presenting a larger surface area in contact with the air and thereby enhance heat transfer. The fins may include apertures that receive the tubes. The fins are securely held in thermal contact with the tubes. By the forced convection caused by a fan system, heat is transferred between the fin material and the circulating air. By thermal contact with the tubes, the fins conduct heat between the externally circulating air and the refrigerant fluid in the heat exchanger tubes.

Finned tube heat exchangers are widely used in a variety of applications, including refrigeration, air-conditioning and the like. Such heat exchangers have spaced parallel tubes in which a first heat transfer fluid such as water, oil, air or a refrigerant flows while a second heat transfer fluid such as air is directed across the outside of the tubes. Usually multiple fins are arranged in a parallel relationship between the tubes to form multiple paths for the second heat transfer fluid to flow across the fins and around the tubes.

Fin design is one factor in determining the heat transfer efficiency of a heat exchanger. Numerous fin designs have been proposed in the prior art to enhance heat transfer efficiency, compactness and manufacturability of finned tube heat exchangers. Many of these designs involve enhancements to the fins such as interrupting the fins with louvers that cause disruption of hydrodynamic boundary layers which form with increasing thickness along the fins and decrease heat transfer efficiency. Typically, such louvers are formed by first cutting the fin sheet at selected locations and then in a separate operation punching the fin material to form the louvers. Examples of prior art louvered fin heat exchangers are disclosed in U.S. Pat. Nos. 4,723,599 and 5,042,576.

Although louvered fins are advantageous from a heat transfer efficiency standpoint, the formation of the louvers adds complexity to the manufacturing process because two additional steps are typically involved—cutting the fin material and then pushing the material up or down to form the louvers. Further, formation of the louvers increases mechanical stresses on the fin sheets, which can cause deformation of the fins and other problems during the manufacturing process.

In general, prior art fin louvered geometries tend to become air side pressure limited as the fin density increases due to inadequate airflow passages. Other things being equal, the number of fins in contact with refrigerant tubes is a primary determinant of the thermal hydraulic efficiency of heat exchangers. It would be desirable to address problems of ineffective and suboptimal louver alignments between fins that are evident in some prior art approaches.

U.S. Pat. No. 5,509,469 discloses a flat fin heat exchanger with louvers and a rib that is raised above the plane of the fin that connects adjacent tube collars. The raised rib is said to enhance the heat transfer characteristics of the fin while allowing thinner materials to be used, thereby lowering costs without diminishing performance.

U.S. Pat. No. 5,752,567 discloses reinforcing ribs (22), longitudinally spaced flat portions (24,24a) and a central corrugated portion (26).

U.S. Pat. No. 5,730,214 discloses a heat exchanger with a corrugated cooling fin (FIG. 6) that has a louver pattern in which the louvers in a first lead set successively rise in tilt angle in the direction of airflow. Matching air louvers in a trailing set successively decrease in tilt angle.

U.S. Pat. No. 6,805,193 discloses a fin louver arrangement that uses breaking and reversal louvers, the lengths of which are substantially longer than the half length of the main louver but at slightly lower angles to the fin face.

U.S. Pat. No. 4,434,844 discloses a cross-fin coil type heat exchanger with raised fins and louvers that are formed on the surface of a convoluted fin base plate.

Conventional wisdom concerning louvered fin performance is derived from the channeling of airflow over the fin surfaces. At high air velocities, a measure of air turbulence is obtained thru the Reynolds number, the magnitude of which determines whether the airflow will be laminar or turbulent. Under turbulent conditions, heat transfer is maximized due to disturbance of boundary layers. This stems from the fact that heat transferred from the fin surface to the air is dependent on the thickness of the viscous region adjacent to the fin and the boundary layer, which in turn is dependent on the magnitude of the Reynolds number.

Today, HVAC/R systems are challenged to consume less energy and be more efficient in their operation. One means to accomplish this is the use of lower air speeds across the heat exchanger surfaces. Smaller motors consume less energy and produce a cost savings. Low airflow results in low Reynolds numbers, and laminar flow dominates. One method to overcome this performance deficiency is to increase fin density. Under such conditions, prior art louver designs are ineffective due to the suboptimal louver alignment between fins.

Acceptable fin structures must be both cost effective and efficient. However, often a more efficient design proves to be more expensive in terms of materials and/or manufacturing. Conversely, relatively simple designs tend to be less desirable because of inferior heat transfer characteristics. Therefore, a more efficient and economically viable heat exchanger fin design is sought. Also, it is desirable to minimize material costs by using thinner sheet metal, as conventional designs are already made with sheet metal which is as thin as practical.

Against this background, there is a need for an improved finned tube heat exchanger that achieves a lower air side pressure drop at a high fin density without sacrificing thermal performance.

SUMMARY OF THE INVENTION

It is an object of the present invention to improve thermal hydraulic efficiency, thereby addressing societal needs to reduce energy consumption.

To meet these needs, the invention discloses louvered enhancements of heat exchanger fins that are used in air-conditioning systems and heat pumps. The invention includes a fin heat exchanger configuration with louvers formed from the planes of fins that lie between adjacent tube collars. Thus, the invention discloses a heat exchanger assembly that includes one or more heat transfer tubes that in one embodiment are substantially parallel to one another. In contact with at least some of the tubes is a plurality of fins that usually are substantially perpendicular to the heat transfer tubes. In most embodiments, they lie parallel to one another.

At least some of the fins have a predetermined pattern of louvers. Preferably, most of the fins are predominantly flat, except for louvers that extend from a basal plane of the associated fin.

In general, the louvers in a given fin section are characterized by the relationship of louver pitch, louver angle and fin spacing. One measure of louver geometry is a dimensionless parameter F, derived from the tangent of the louver angle ($\alpha$) multiplied by the louver pitch ($P_L$) divided by the fin pitch ($P_F$). Alternatively expressed, $$F=P_L \tan(\alpha)/P_F.$$

Preferably, that value of F lies in the range of about 0.20 to 0.65.

The subject invention in at least some embodiments creates two types of flow: (a) louver-directed flow and (b) tunnel flow. In general, for HVAC/R heat exchangers, louver-directed flow is effective at high Reynolds numbers; tunnel flow is more effective at low Reynolds numbers.

In a manner to be explained in more detail later, louver interaction with flowing air has been simulated by computational fluid dynamics (CFD). The beneficial effect of low airflow over the disclosed louver configuration was unexpected.

In one aspect, the present invention provides an exterior fin surface which redirects air flow from the leading edge to the trailing edge of the fin. Heat transfer coefficients are higher near or at the leading edge of a fin or louver surface. This effect directs the air flow over and in between the interrupted surfaces, thus breaking up air boundary layers around the fin. The louvers of the fin are presented to the air flow so that each louver effectively provides another leading edge, thus contributing to the enhanced heat transfer characteristics of the fin.

Accordingly, one attribute of the present invention is to provide a more efficient and economically viable heat exchanger fin design.

Another advantage of the present invention is that the fin configuration may be formed in a single stage tool enhancement station in the overall fin die, thus lowering the cost of manufacture.

A further advantage of the invention involves minimizing material costs by using thinner sheet metal while maintaining the structural integrity of the fin. The configuration of the present invention reduces the amount of material in the fin by as much as 15%. This is a significant cost savings, especially where aluminum is the material chosen for the fin.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein:

FIG. 1 is a perspective, partially broken away view of a prior art condenser heat exchanger, wherein

FIG. 2A is a side elevational view of a fin in the orientation of FIG. 1, wherein

FIG. 5B illustrates a top view, whereas

Figure 1:
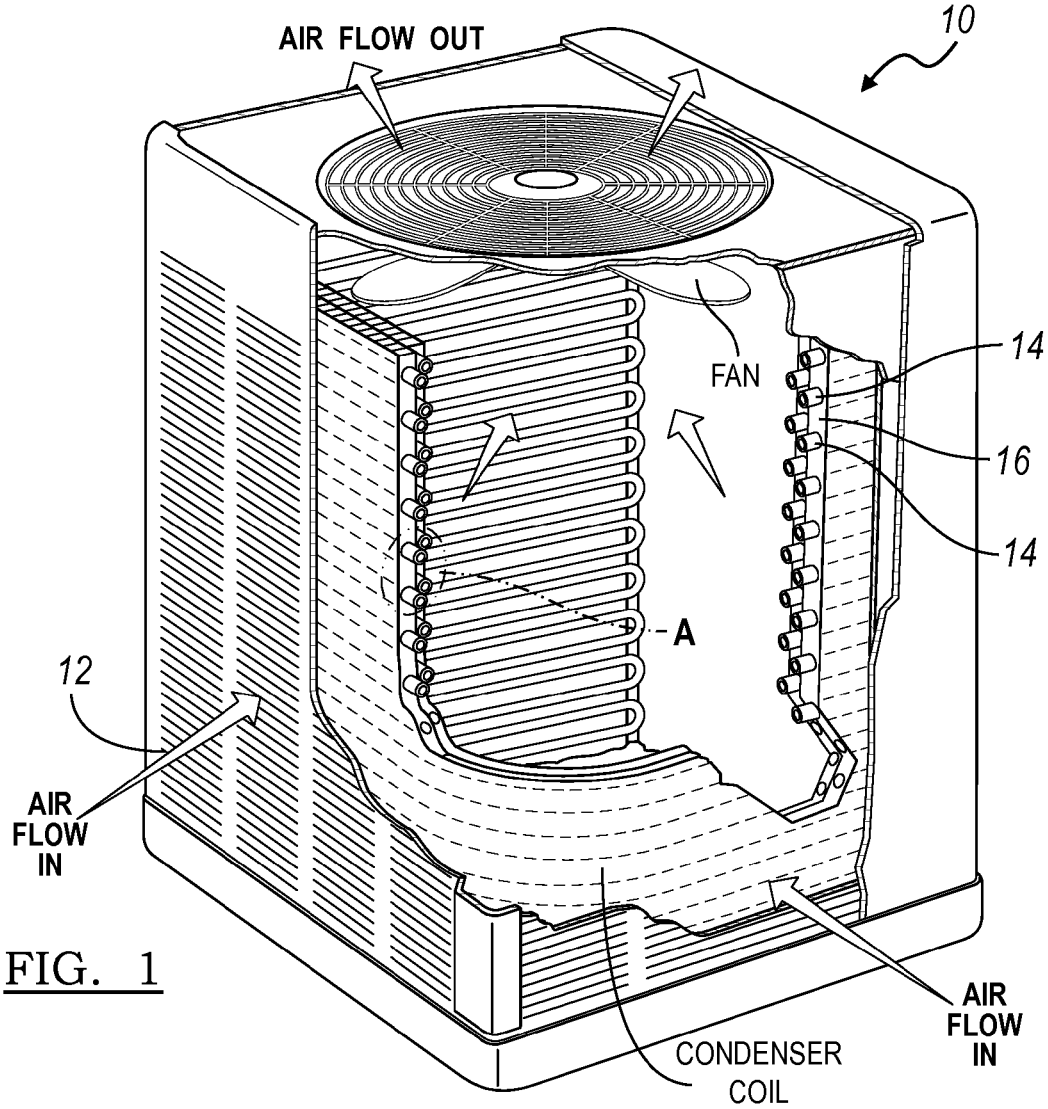
Figure 1A:
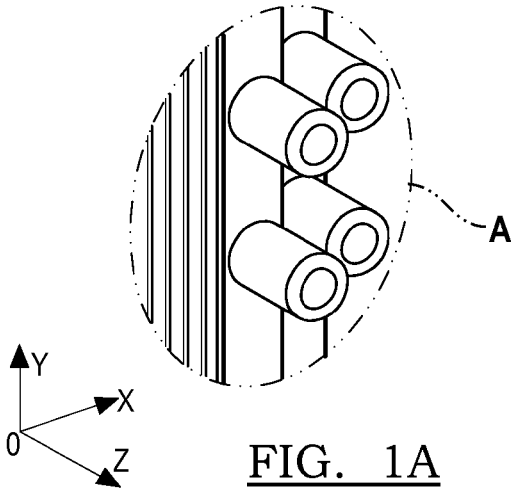
FIG. 1A is a close up sectional view of a portion of representative refrigerant tubes in heat exchanger fins.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates preferred embodiments of the invention, in several forms, and such exemplifications are not to be construed as limiting the scope of the invention in any manner.

DETAILED DESCRIPTION OF THE PREFERRED EMBODIMENT(S)

The invention relates to heat exchanger 10 that lies in the path of air 12 (FIG. 1). Conventionally, air flow through the assembly is promoted by a fan. Where the heat exchanger is a central air conditioning unit, the assembly includes a condenser that is provided with one or more rows of heat exchanger coils. A structure akin to the heat exchanger depicted in FIG. 1 may be used in a condenser or in an evaporator. In many cases, the assembly is situated in the outdoor or indoor unit of an air conditioning or heat pump system.

The heat exchanger assembly 10 includes at least one series of fluidly connected heat transfer tubes 14 that are in thermal contact with a plurality of fins 16. Preferably, the fins 16 are closely spaced. They serve as thermal conduits between refrigerant fluid that flows in the tubes 14 and the air which moves over the surfaces of fins 16 under the influence of the fan.

Figure 2A:
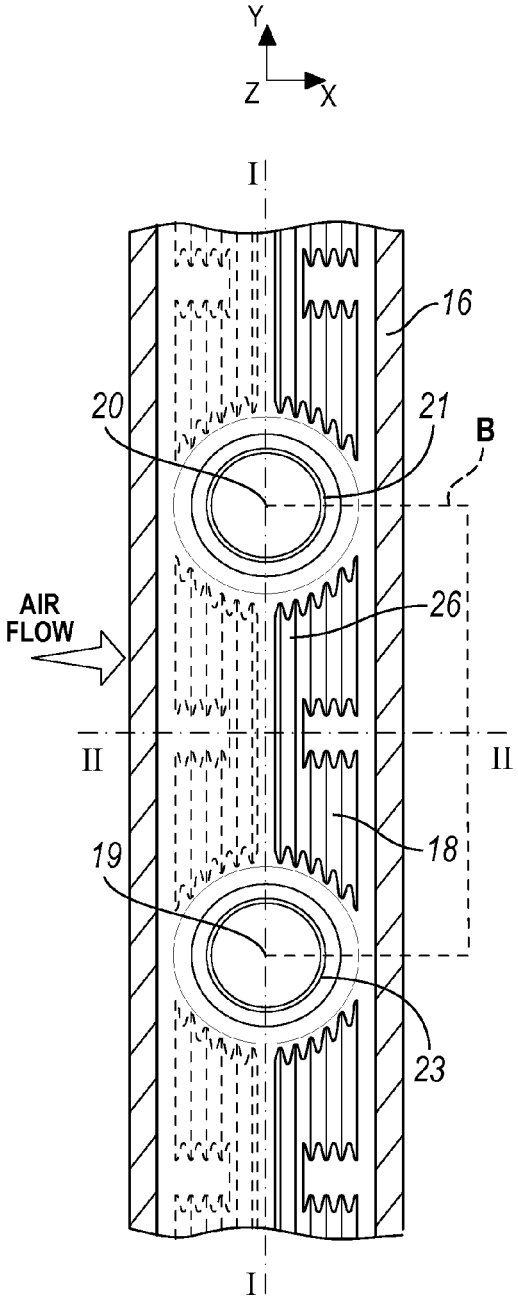

The assemblies contemplated by the presented invention include in most embodiments fins that are substantially planar. At least some of the fins 16 have a predetermined pattern of louvers 18 (FIG. 2) that are formed from the fin plates.

In FIG. 1, it can be inferred that at least some of the heat transfer tubes are substantially parallel to one another and that the plurality of fins are substantially perpendicular to the plurality of heat transfer tubes. Preferably, the plurality of fins include at least some fins that are substantially parallel to one another. It will be appreciated that the orientation of FIG. 1 suggests that the tubes 14 run horizontally and that the fins 16 lie generally vertically. In fact, the invention is not so limited. Depending on the environment of use, advantages may be gained if the fins run generally horizontally and the tubes are oriented vertically.

Turning now to FIG. 2, there is depicted one representative fin 16 that, in the region shown, includes two apertures that receive tubes which pass therethrough. The tubes can be characterized by longitudinal axes 19, 20. Collars 21, 23 encircle cross sections of the tubes where those sections intersect the fin 16. A section through a base fin is depicted in FIG. 4 that also shows an imaginary tube axis 20 and a portion of a fin collar 21.

Each fin 16 has a leading edge which is exposed to incident air which flows through the heat exchanger. In general, the fin plane is substantially disposed in parallel to the direction of air flow. Edges of the fin 16 and louvers 18 duct the air between and over the surfaces of fins 16. This action tends to inhibit the formation and growth of boundary layers that may otherwise lie contiguously with generally flat sections of the fin 16.

Figure 3A:
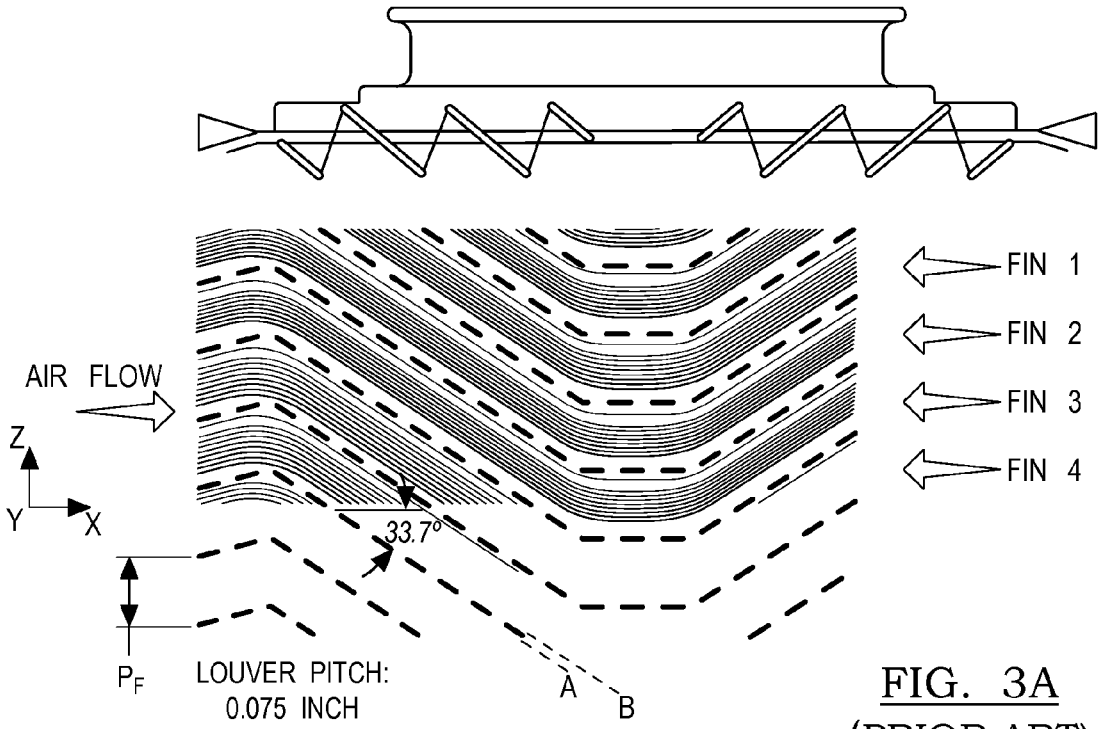
FIG. 3A (PRIOR ART)
FIG. 3A is a sectional view orthogonal to the plane of a conventional fin.
Figure 3B:
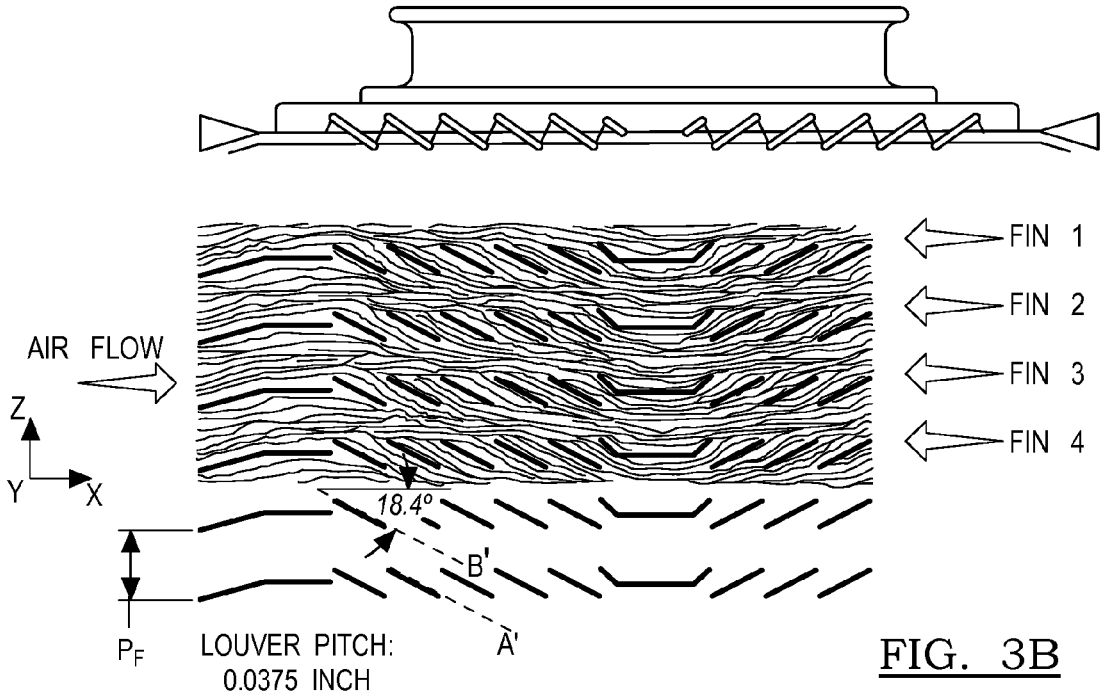
FIG. 3B is a view that corresponds to FIG. 3A, except that it depicts one embodiment of the invention.

As suggested in FIG. 3B, turbulence tends to begin at the leading edge of a fin and continues past its trailing edge. Generally, heat transfer coefficients are higher near or at the leading edge of a surface from which a boundary layer may develop. Together, the fin leading edges and the louvers serve as multiple leading edges which initiate their own boundary layers and thus promote heat transfer.

Figure 4:
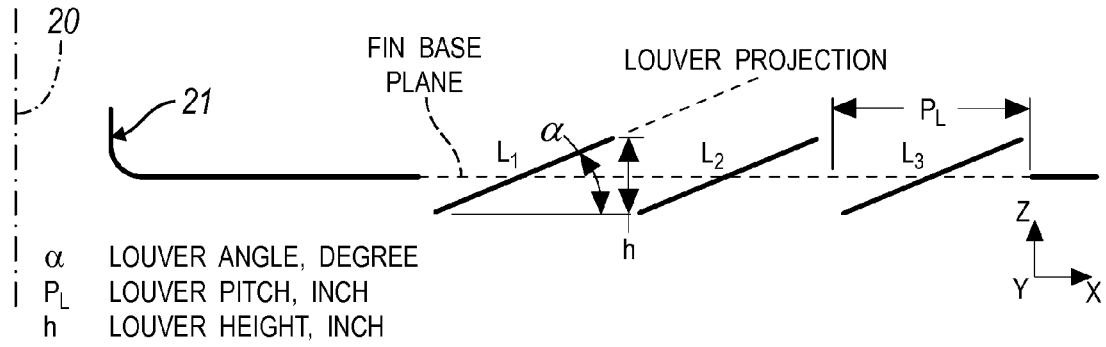
FIG. 4 illustrates the basic definitional terms of the fin louvers, such as louver angle, pitch, and height used in this disclosure.
Figure 4A:
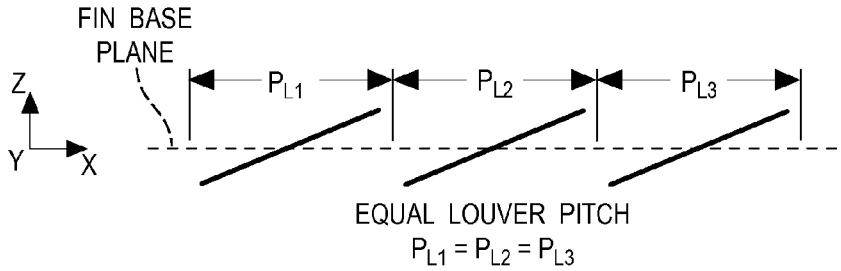
FIGS. 4A-4C illustrate variations in louver cross section and louver pitch.
Figure 4B:
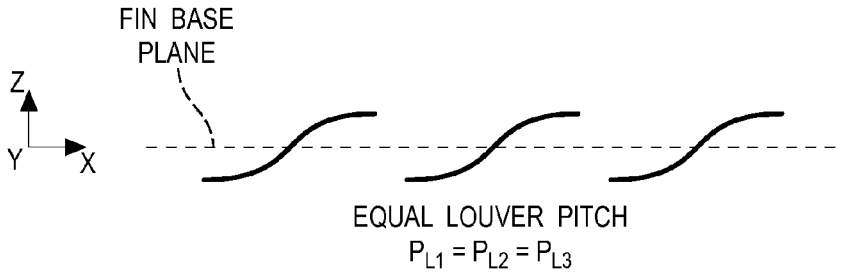
Figure 4C:
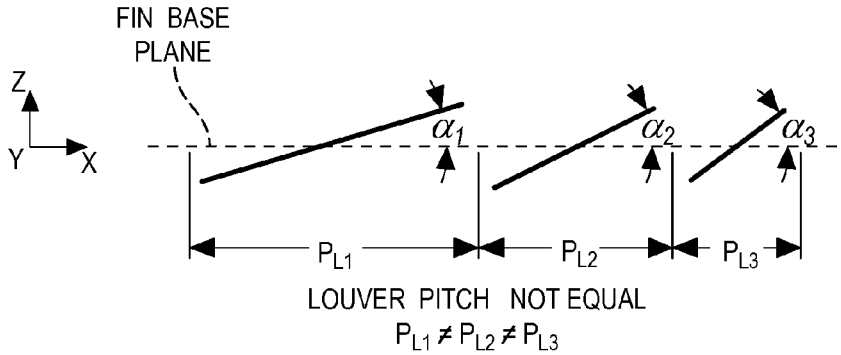

Reverting to FIGS. 2A-4C, at least some of the fins 16 have a predetermined pattern of louvers 18. FIGS. 4-4C are helpful in defining terms used in this specification to describe alternative louver patterns. Those terms include louver angle $\alpha$, louver pitch $P_L$, fin pitch $P_F$, and louver height h. Various patterns are characterized FIGS. 4A-4C by louver pitch $P_L$, louver angle ($\alpha$), and fin pitch $P_F$.

It will be appreciated that in some embodiments, there are fins that have louvers which have a uniform height h. Other fins may define a pattern of louvers that have louvers with a non-uniform height.

Based on the geometric configuration illustrated, a dimensionless parameter F can be derived to describe louver interaction with bulk flow:

$$F=P_L \tan(\alpha)/P_F$$

The parameter F is influenced by louver alignment, which in turn influences flow pattern and heat transfer behavior. Two non-limiting examples of fin geometries are illustrated in FIGS. 3A and 3B. FIG. 3A illustrates a louver alignment which is almost precisely in-line with $\alpha$ equaling 33.7° and louver pitch is 0.075 inches. In that figure, the plane (A) of a louver in a fin when projected lies in a plane that is virtually co-planar with the plane (B) of a louver associated with an adjacent fin. In comparison, FIG. 3B for example, has a relatively evenly staggered louver alignment with $\alpha$=18.4° and louver pitch is 0.0375 inches. The planes A'-B' are spaced apart.

By experiment, the flow patterns were examined for the two fin designs. The fin configuration in FIG. 3B represents a transition case of louver-directed flow to tunnel flow. In FIG. 3A, flow is predominantly louver-directed. Two aspects are relevant to the flow pattern and heat transfer behavior. One is the effect of louvers on tunnel flow, in which most fluid goes through the flow "tunnel" between adjacent fins. In those cases, louvers serve to disturb bulk flow. The amount of such louver disturbance can be estimated from the above formula for the dimensionless parameter F.

Another factor that influences flow pattern and heat transfer behavior is louver interaction in louver-directed flows in which flow primarily depends upon the discharge of fluid from the louver openings upstream. This phenomenon is associated with frequency of louver appearance along the louver direction which approximates the flow direction in typical louver-directed flow patterns. Additional detail is presented and discussed in a manuscript entitled "AIR FLOW AND HEAT TRANSFER IN LOUVER-FIN ROUND-TUBE HEAT EXCHANGERS" by H. L. Wu et al., ASME Journal of Heat Transfer, Feb. 9, 2007. That manuscript is incorporated herein by reference.

By experiment, optimal results are realized when F is between about 0.20 and 0.65. Preferably, $P_F$ is about 2-30 fins per inch and more preferably between about 20 and 30 fins per inch.

Turning back to FIGS. 2A and 2B, there is depicted a fin that receives tubes 14 (not shown) that have imaginary longitudinal axes 19, 20. The predetermined pattern of louvers 18 associated with a fin 16 can be defined in relation to the tube hole centers, or the axes 19, 20. As shown, the louvers have end portions 24 that lie at a radial distance $r_L$ from the tube axis or tube hole center 19, 20.

In one embodiment, the radial distance $r_L$ from a given tube hole center to the end portions 24 of louvers in at least one pattern of louver is relatively constant.

Figure 2B:
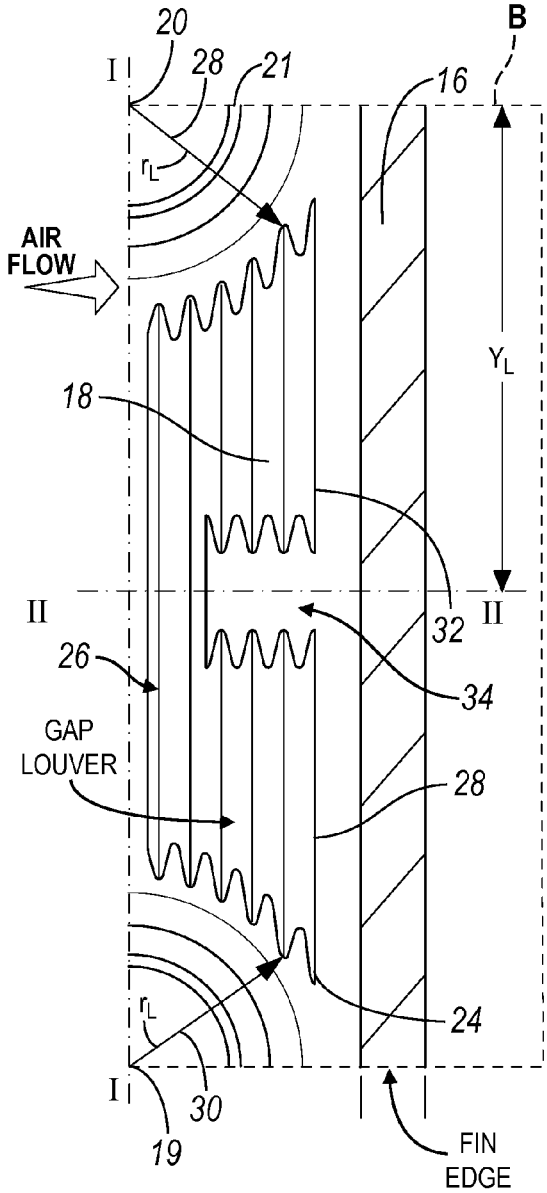
FIG. 2B is a close up view of area B of FIG. 2A.

FIG. 2B depicts an embodiment wherein the radial distant $r_L$ from a given tube axis 19 equals the radial distance from an adjacent tube axis 20. In this case, the pattern of louvers have end portions 24 that terminate at about the same distance from each tube axis.

Continuing with primary reference to FIG. 2B, it can be seen that at least some of the louvers 18 comprise gap louvers 32 that are interrupted by one or more gaps 34. One function of the gaps 34 is to avoid distortion of louver profile openings that might arise from the relatively long louver length in the Y direction. In other cases, at least some of the louvers 18 comprise bridge louvers 26 that run continuously between radii 28, 30 that emanate from the centers 19, 20 of adjacent tube holes. In some embodiments, the pattern of louvers 18 is selected from a group consisting of gap louvers 34, bridge louvers 26, and combinations thereof.

Continuing with reference to FIGS. 3A and 3B, it will be appreciated that sectional views of representative fins are depicted. In FIG. 3A, it will be appreciated that one fin may have a louver that lies in a first plane (A). By comparison, an adjacent fin (either over or under the previously referenced fin) has a louver that lies in a plane (B). In FIG. 3B, at least some of the louvers in the adjacent fin are configured such that the projections of planes (A) and (B) are spaced apart so that resistance to passage of air flowing through the assembly is reduced. Compare, for example, the relationship of planes A-B (FIG. 3A) with planes A'-B' (FIG. 3B). In the embodiment depicted in FIG. 3B, a substantial amount of air entering the assembly between any two fins emerges from between the same two fins, thereby minimizing air-side pressure drop.

The inventors have observed that interference between fins is minor even at a high fin density (greater than 24 fins per inch). This enables the coil to maintain its effectiveness. Thus, the invention effectively doubles the number of air channel disturbances without increasing the total length of the louver bank.

Continuing with primary reference to FIGS. 4A-4C, it will be appreciated that each of the louvers in a given fin can be characterized as lying in a plane that is substantially flat. See, FIG. 4A. In FIG. 4B, however, at least some of the louvers have a topography. In the embodiment illustrated, the topography includes at least some regions of a fin that are curved, while other regions may be curved and linear. As used herein, the term "curvilinear" means a section that includes both flat and curved sections.

The sketch appearing in FIG. 4C illustrates a situation in which louver pitch is unequal between louvers associated with a given fin. Additionally or alternatively, at least some of the louvers associated with a fin may have unequal louver angles.

Figure 5A:
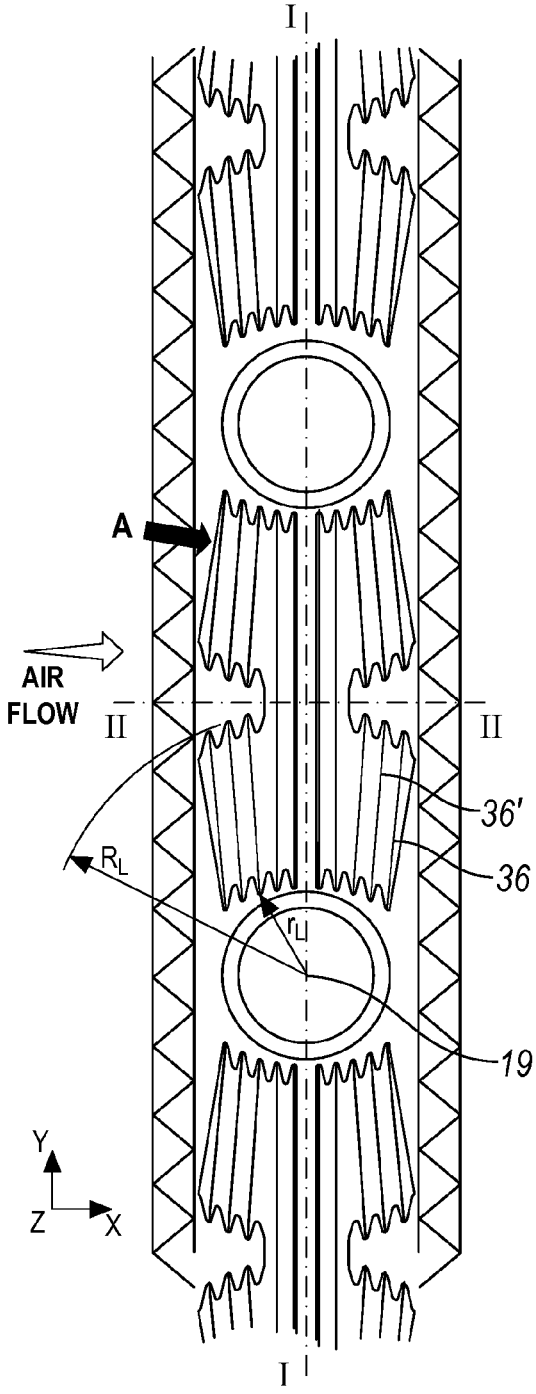
FIG. 5A is a side elevational view of embodiment of an inventive fin with asymmetric louver patterns.

Turning now to FIG. 5A, it is apparent that at least some of the gap louvers 36 may be oriented with a radial component. As used herein, the term "radial component" denotes a louver orientation that deviates from parallelism with a longitudinal axis of a given fin. The term is not limited to an orientation that lies along a radius from a tube center.

Figure 5B:
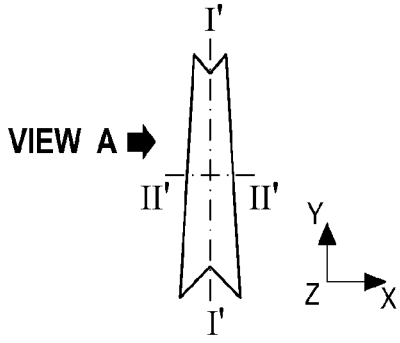
Figure 5C:
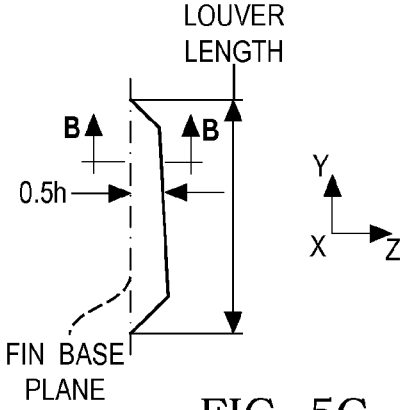
FIG. 5C illustrates a view from the A direction of FIG. 5A.
Figure 5D:
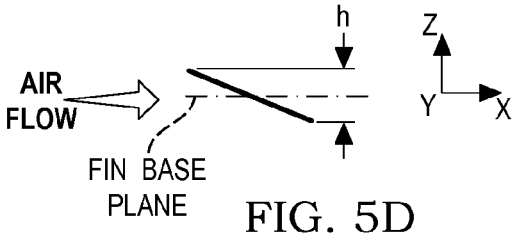
FIG. 5D illustrates a sectional view along the plane B-B of a second louver embodiment of the present invention.

FIG. 5B (top view) illustrates a gap louver configuration wherein two adjacent louvers have edges that diverge from each other as distance from a center line drawn between adjacent tube holes increases. Relatedly, in some embodiments, some of the louvers associated with a fin may have a pitch that varies along the length of the louver. Thus, the louver profile may be asymmetrical and the louver height may vary along the distance from $r_L$ to $R_L$.

Figure 6:
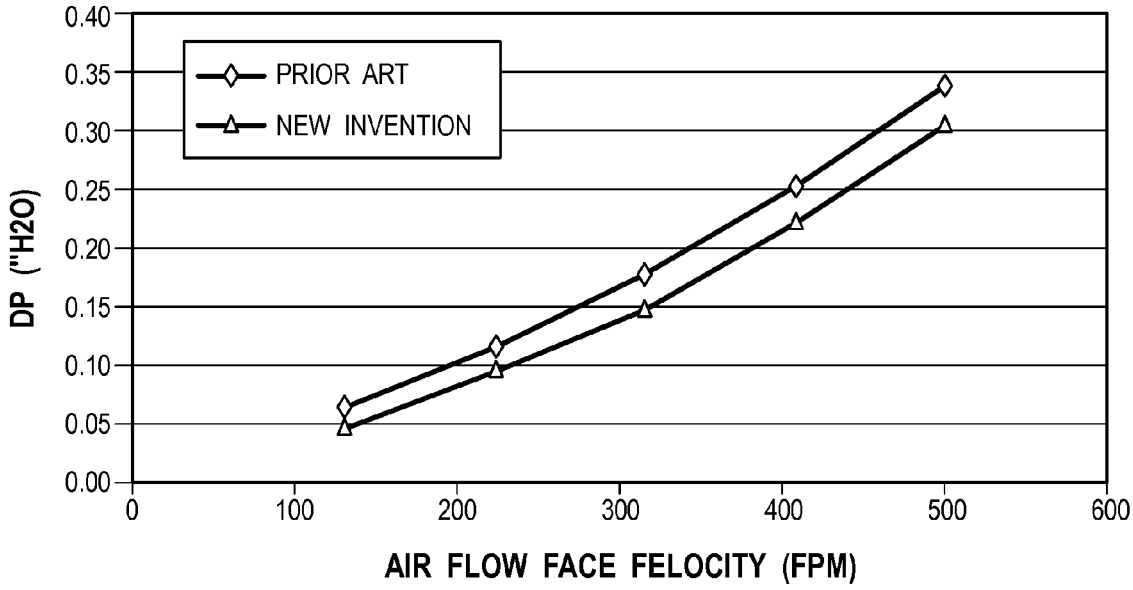
FIG. 6 graphs observed air flow face velocity against air side pressure drop for prior art louvers and for the present invention louvers.

FIG. 6 discloses experimental data that compares the air side pressure drop as a function of air flow face velocity. The experimental data show that the invention has almost the same heat transfer performance as a prior art design at a given airflow face velocity, but has between 9 and 19 percent less air side pressure drop.

Example of Performance Improvement Attributable to the Invention

Summarized below are exchanger wind tunnel test results observed in the face of a 200- to 500-ft/min air velocity:

| | Prior Art | Invention |
|---|---|---|
| Thermal Hydraulic Performance (Heat rejected/air pressure drop, BTU/Hr/in water) | 7.825 | 8.972** |
| Louver Geometric Pressure (F.) = $P_L\tan(\alpha)/P_F$ | 1.1 | 0.3 |

**14.65% improvement

Figure 7:
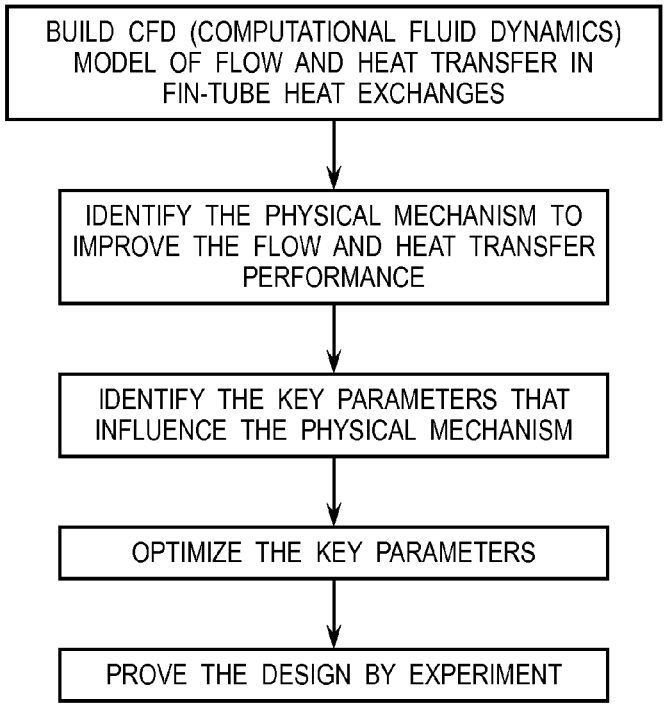
FIG. 7 is a flow chart of design methodology.

FIG. 7 is an overall view of the design methodology employed before manufacturing a heat exchanger by invoking the various features of the present invention. The main steps are:

(1) build a computational fluid dynamics (CFD) model of flow and heat transfer in fin-tube heat exchangers;

(2) identify the physical mechanism to improve the heat flow and heat transfer performance;

(3) identify the key parameters that influence the physical mechanism;

(4) optimize the key parameters; and (5) prove the design by experiment.

In any of the disclosed embodiments, the fins preferably are manufactured out of a roll of stock metal material, e.g. an aluminum alloy such as AA 1100. Other suitable materials include copper, brass, nickel, and material with similar properties. The configuration of the fin body is often formed in a one step enhancement die stage process to define the required louver structure.

The single row arrangement, shown in the drawings for ease of understanding, may be applied to multiple row designs. Once the fin stock is appropriately formed, the heat exchanger tubes are inserted into the fin apertures and the tube ends are connected to form the heat exchanger coils. The open ends of the coils are then suitably connected to the refrigerant lines of the air conditioning or heat pump system.

Today, HVAC/R systems are challenged to consume less energy and be more efficient in their operation. One means to accomplish this is the use of lower air speeds across the heat exchanger surfaces. Smaller motors consume less energy and produce a cost savings. Low airflow results in very low Reynolds number flow, clearly in the laminar flow regime. Under such conditions, prior art louver designs are ineffective due to the improper louver alignment between fins.

Thus, the invention relates to an improved finned tube heat exchanger that achieves lower airside pressure drop at high fin pitch (high fin density) without sacrificing thermal performance. This is achieved through louvered enhancements of the heat exchanger fins typically used in air conditioning systems and heat pumps. The number of fins in contact with the refrigerant tubes determines the thermal hydraulic efficiency of said heat exchangers. Prior art fin louvered geometries become airside limited as the fin density increases due to their inadequate airflow passages. This invention addresses this shortcoming and allows for a high fin density with concomitant improvements in airside pressure drop and heat transfer. Such improvements in thermal hydraulic efficiency address the societal need to reduce energy consumption.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A heat exchanger assembly for use as a residential/industrial heating, ventilation, air conditioning refrigeration system that lies in the path of oncoming air, the assembly comprising:

a plurality of heat transfer tubes;

a plurality of fins, at least some of which being in contact with the plurality of heat transfer tubes;

at least some of the plurality of fins having a predetermined array in which one or more fins has a predetermined pattern of louvers, the geometry of which is characterized by a dimensionless parameter F that is a function of louver pitch $P_L$, louver angle $\alpha$, and fin pitch $P_F$, such that the tangent of the louver angle times the louver pitch divided by the fin pitch is between about 0.20 and 0.65, where $20 \leqq P_F \leqq 30$ fins per inch; and wherein the tubes have longitudinal axes at a tube center thereof and the predetermined pattern of louvers associated with a fin is defined in relation to the centers of adjacent tube holes in the fins that receive the tubes, such that the louvers have end portions that lie at a constant radial distance $r_L$ from the tube axis, the louvers being parallel to an edge of the fin.

2. The heat exchanger assembly of claim 1, where the fin pitch $P_F$ is between about 25 to 30 fins per inch.

3. The heat exchanger assembly of claim 1, where the louver angle $\alpha$ is between about 20 to 35 degrees.

4. The heat exchanger assembly of claim 1, wherein the radial distance $r_L$ from a given tube hole center to the end portions of louvers in at least one pattern of louvers is constant.

5. The heat exchanger assembly of claim 1, wherein the radial distance $r_L$ from a given tube hole center equals the radial distance from an adjacent tube hole center and the pattern of louvers includes louvers with ends that terminate at the distance $r_L$ from each tube hole center.

6. The heat exchanger of claim 5, wherein at least some of the louvers comprise bridge louvers that run continuously between radii $r_L$ emanating from adjacent tube hole centers.

7. The heat exchanger of claim 5, wherein at least some of the louvers comprise gap louvers that are interrupted by one or more gaps.

8. The heat exchanger of claim 7, wherein at least some of the gap louvers are oriented with a radial component.

9. The heat exchanger of claim 7, wherein at least some of the gap louvers lie between $r_L$ and $R_L$ such that at least two adjacent louvers have edges that diverge from each other as distance from a tube hole center increases.

10. The heat exchanger of claim 5, wherein the pattern of louvers is selected from a group consisting of gap louvers, bridge louvers and combinations thereof.

11. The heat exchanger of claim 5, wherein the pattern of louvers associated with a given fin includes one or more louvers that have a uniform height h.

12. The heat exchanger of claim 5, wherein the pattern of louvers associated with a given fin includes louvers with unequal heights.

13. The heat exchanger of claim 1, wherein a fin has a louver that lies in a first plane (A) and an adjacent fin has a louver that lies in a plane (B) and at least some of the louvers in the adjacent fin are configured such that projections of planes (A) and (B) are spaced apart so that resistance to the passage of air flowing through the assembly is reduced.

14. The heat exchanger of claim 13, wherein a substantial amount of air entering the assembly between two fins that are interposed in a path of air moving at a velocity of 200-500 ft/mm is contained between and emerges from the assembly from between the same two fins, thereby minimizing air-side pressure drop.

15. The heat exchanger of claim 13, wherein plane (A) associated with a louver is substantially flat.

16. The heat exchanger of claim 13, wherein plane (A) associated with a louver has a topography that includes at least some regions that are curved.

17. The heat exchanger of claim 13, wherein plane (A) associated with a louver has a topography that includes at least some regions that are curvilinear.

18. The heat exchanger of claim 1, wherein at least some of the louvers associated with a fin have unequal pitches $P_L$.

19. The heat exchanger of claim 1, wherein at least some of the louvers associated with a fin have unequal louver angles $\alpha$.

20. The heat exchanger of claim 1, wherein at least some of the louvers associated with a fin have a pitch $P_L$ that varies along the length of the louver.

* * * * *